US005799847A

United States Patent [19]

Sandor

[11] Patent Number: 5,799,847

[45] Date of Patent: Sep. 1, 1998

[54] TOOL HANGING DEVICE

[76] Inventor: Joseph Sandor, 203 Coral Ave., Balboa Island, Calif. 92662

[21] Appl. No.: 841,924

[22] Filed: Apr. 8, 1997

[51] Int. Cl.[6] ..... B65D 25/52

[52] U.S. Cl. ..... 224/197; 224/271; 224/904; 248/223.41

[58] Field of Search ..... 248/220.22, 223.41, 248/222.41, 682; 224/197, 198, 271, 272, 904; 24/3.11, 3.12, 3.1, 575, 680, 666

[56] References Cited

U.S. PATENT DOCUMENTS

| | | | |
|---|---|---|---|
| 3,878,589 | 4/1975 | Schaefer | 224/272 X |
| 4,419,794 | 12/1983 | Horton, Jr. et al. | 224/197 X |
| 4,676,420 | 6/1987 | Sharp | 224/197 X |
| 4,718,586 | 1/1988 | Hagino | 224/197 X |
| 5,014,892 | 5/1991 | Copeland | 224/271 |
| 5,054,170 | 10/1991 | Otrusina | 224/197 X |
| 5,188,325 | 2/1993 | Hilty et al. | 248/223.41 X |
| 5,201,858 | 4/1993 | Otrusina | 224/197 X |
| 5,375,749 | 12/1994 | Oliva | 224/271 |
| 5,584,423 | 12/1996 | Wang | 224/197 |
| 5,597,102 | 1/1997 | Saarikko et al. | 224/197 |
| 5,620,120 | 4/1997 | Tien | 224/197 X |
| 5,622,296 | 4/1997 | Pirhonen et al. | 224/272 X |

FOREIGN PATENT DOCUMENTS

| | | | |
|---|---|---|---|
| 23423 | of 1906 | United Kingdom | 224/197 |

*Primary Examiner*—Leslie A. Braun
*Assistant Examiner*—Long Dinh Phan
*Attorney, Agent, or Firm*—Edgar W. Averill, Jr.

[57] ABSTRACT

A tool hanging device having two parts. One part is attached to a tool. The second part is a slotted member which is attached to a support surface such as a person's belt. One of the parts such as the part attached to the tool has a button held to the end of an oblong stud. The slotted member which is attached to the person's belt has a front plate with a V-shaped opening and at the bottom of the V-shaped opening is a throat into which the oblong stud will only fit lengthwise. Below the throat is an enlarged stud holding area. The button holds the stud and thus, the tool, in the slotted member and the tool is permitted to hang freely supported by the slotted member. The tool is removed by rotating the tool 90° from a free-hanging position to orient the oblong stud so that it will pass upwardly through the throat.

12 Claims, 3 Drawing Sheets

TOOL HANGING DEVICE

BACKGROUND OF THE INVENTION

The field of the invention is tool holding members and the invention relates more particularly to holding members which are useful for supporting a tool on a person's belt or other support surface. The term "tool" is used herein in the broad sense to include any useful device such as a bar code scanner or a palm held computer.

With the ever increasing use of battery powered devices, it is more and more common for a workman or other employee to hold a tool such as a battery operated device from his or her belt and remove it when needed. Because batteries are inherently heavy, it is important for comfort that the tool be permitted to hang freely so that when the user bends forward the tool does not tend to pull or twist on the user's belt. It is also desirable that the tool be easily removed without the necessity of unsnapping a flap such as that commonly used on various holsters. At the same time, the device should allow the easy natural removal of the tool. Applicant has invented a device shown in FIGS. 8 and 9 of the drawings which used a button-like device similar to that shown in FIG. 5 of the drawings. This device has a slotted member shown in FIG. 8 which has an upperly directed V-shaped opening. The V-shaped opening narrows to a doorway formed by a V-shaped protrusion. A button or stub member such as that shown in FIG. 5 passes through the doorway only when the oblong portion of the device in FIG. 5, which is shown in FIG. 7, is oriented in the correct direction. Unfortunately, because of the short length of the doorway, a wearer hardly noticed the device dropping through the doorway and occasionally a wearer would place a device into the slotted member and think that it had fallen through the doorway and instead, it was supported above the doorway. In this position the device can easily fall out and be damaged.

SUMMARY OF THE INVENTION

It is an object of the present invention to provide a tool holding device which gives the user a better sense of when the tool has passed into the lower part of the slotted member. It is another object of the present invention to provide a tool holding device which holds the tool in a manner where it will not swing away or toward the user but is more securely held in a vertical position.

The present invention is for a tool hanging device having a first member affixed to a tool and a second member affixed to a hanging surface such as a wearer's belt. One of the first and second members is a slotted member which has a front plate with an outer face and an inner face and a thickness. The front plate has an open area behind it. The front plate also has an angled wide mouth opening at a stud receiving end and the wide mouth opening has a stud sliding edge and a stud stopping edge. The stud stopping edge terminates at a stud receiving throat having a throat width with a narrowmost portion and a throat length. The throat continues generally parallel to the stud sliding edge and the stud sliding edge terminates in an enlarged stud holding area. The stud holding area continues around until it intersects the throat. The slotted member has a vertical central axis and the stud sliding edge at the throat has an angle of about 30° plus or minus 5° from the slotted member's central axis. The other of the first and second members is a stud assembly having a supporting plate, a stud member extending outwardly from the supporting plate and the stud member has two rounded ends and is generally oblong in shape. The stud member has a stud width and the stud width is narrower than the stud length and narrower than the narrowmost portion of the throat width. The stud length is greater than the narrowmost portion of the throat width so that the oblong stud can pass through the throat in only one orientation or at an orientation 180° therefrom. The stud member terminates in an overhanging button which overhanging button has a thickness less than the width of the open area behind the front plate. The stud extension distance is greater than the thickness of the front plate so that the button fits into the open area. The stud assembly has a stud assembly vertical central axis and a line extending through a stud central axis of the stud is at an angle about 60° plus or minus 5° with respect to the stud assembly vertical central axis. The throat length of the slotted member is at least the length of one-half of the stud length whereby when a tool is held by one of the first and second members above a tool center of gravity, one of said first and second members is oriented so that it hangs freely with its vertical central axis oriented vertically and the second of the first and second members is affixed to a supporting member such as a belt so that its vertical central axis is oriented vertically and when said tool is dropped into the second of said first and second members, the wide mouth opening contacts the stud and the flange enters the open area behind the front plate. The stud abuts against the stud sliding edge and the stud stopping edge where it is retained against the stud stopping edge and the stud sliding edge adjacent the throat until the tool is rotated about 90° when the oblong stud becomes aligned with the throat and the stud moves into the stud holding area through the throat where it is free to return so that the tool's vertical central axis is generally vertical.

A button contact wedge plate is preferably located in the open area so that the button has very little play and the bottom of the tool cannot swing outwardly very far because of the snug fit of the button against the button contact wedge plate.

DESCRIPTION OF THE PREFERRED EMBODIMENTS

Figure 1:
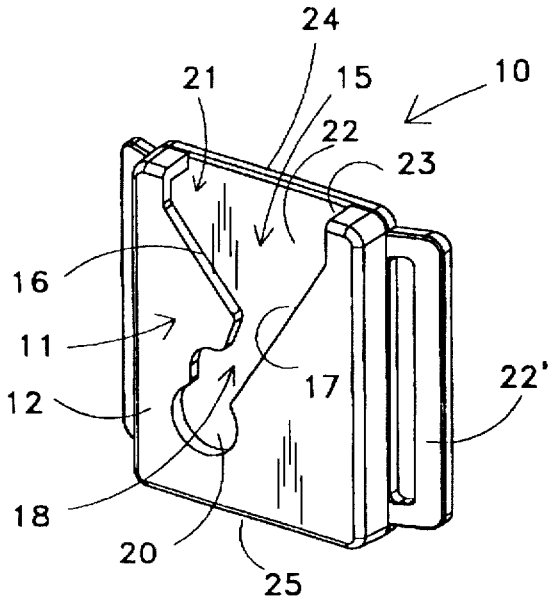
FIG. 1 is a perspective view of the slotted member of the tool hanging a device of the present invention.

The slotted member of the tool hanging device of the present invention is shown in perspective view in FIG. 1 and indicated generally by reference character 10. The slotted member has a front plate 11 which has an outer face 12 and an inner face 13. Front plate 11 has a thickness 14 and has an angled wide mouth opening 15. The wide mouth opening is formed by a stud stopping edge 16 and a stud sliding edge 17. The stud stopping edge terminates in a stud receiving throat 18 which has a length 19 and a throat edge 27. Below the throat edge 27 is a stud holding area 20.

The open area behind the front plate 11 is indicated by reference character 21 and the open area is located between the front plate 11 and the back plate 22. This open area has a width 23.

Figure 2:
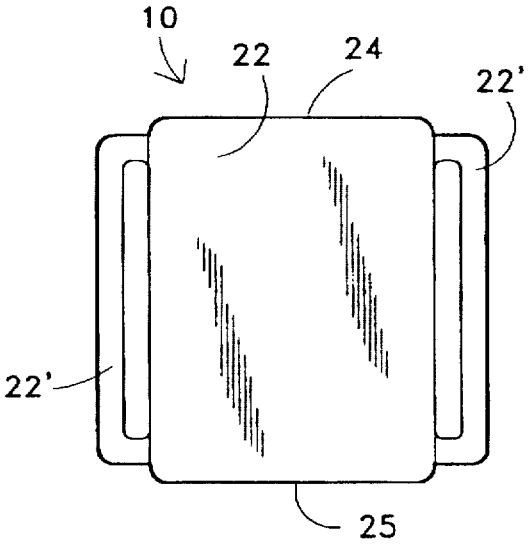
FIG. 2 is a rear view of the slotted member of FIG. 1.

The slotted member 10 has a top 24 and a bottom 25. This slotted member 10 is shown in rear view in FIG. 2 where the back plate can be seen to support a pair of belt loops 22'. The belt loops 22' secure the slotted member 10 to the wearer's belt. Other holding devices which as a clip or hinged clasp can, of course, also be used. Alternatively, the device can be directly adhered or riveted to whatever structure is used to support the slotted member.

Figure 4:
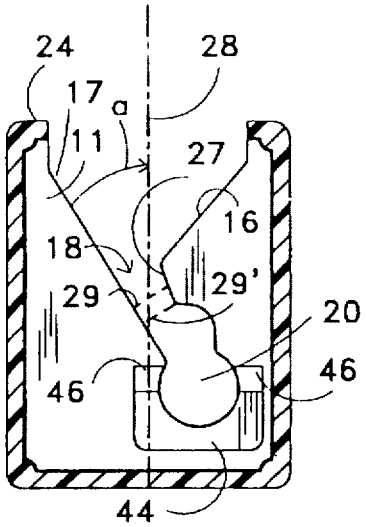
FIG. 4 is a cross-sectional view showing the backside of the front plate of the slotted member of FIG. 1.

The slotted member is shown in front view in FIG. 4 where a vertical central axis is indicated by reference character 28. The stud sliding edge 17 is formed at an angle indicated by reference character "a" to the vertical central axis 28. This angle "a" should be about 30° plus or minus 5°. The angle of this stud sliding edge 17 is particularly important when the device is worn on the user's belt. The user in removing a tool with the user's right hand will naturally and comfortably rotate the tool from its supported vertical position to an approximately horizontal position where the user's hand is comfortably positioned when placed at belt level slightly behind the user's side. The stud (discussed below) will then permit the tool to be easily lifted out of the open area 20.

Figure 5:
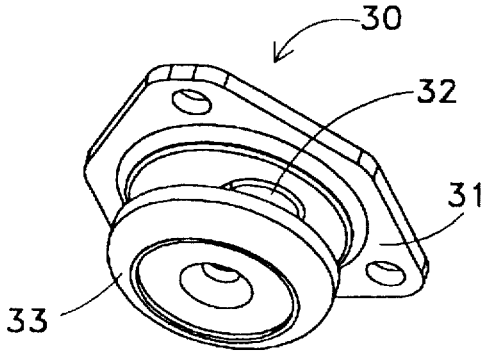
FIG. 5 is a perspective view of the stud assembly of the tool hanging device of the present invention.

A stud assembly may be inserted into the stud receiving end or top 24 of slotted member 10 and such stud assembly is shown in perspective view in FIG. 5 and indicated generally by reference character 30. Stud assembly 30 has a supporting plate 31, a stud member 32 and a button 33. This button or overhanging flange 33 fits into the open area 20 of the slotted member.

The stud assembly 30 is shown in perspective view in FIG. 5 and indicated generally by reference character 30. Stud assembly 30 has a supporting plate 31, a stud member 32 and a button or flange 33. This button or flange 33 fits into the open area 23 and remains in the stud holding area 20 when the tool is being suspended from the slotted member. Although the device of the present invention has been discussed as if the stud assembly is attached to the tool, it is, of course, possible that the stud assembly be attached to a belt or other holding member and the slotted member be attached to the tool.

Figure 6:
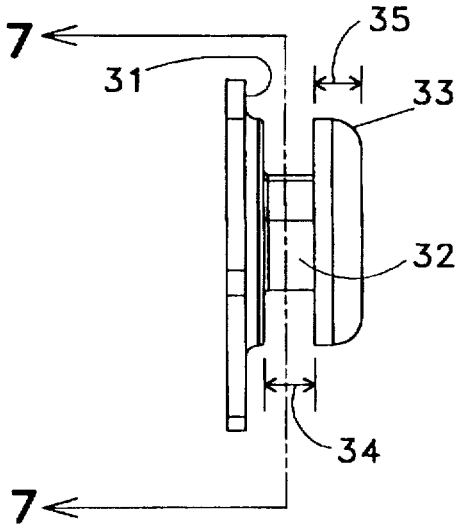
FIG. 6 is a side view of the assembly of FIG. 5.
Figure 7:
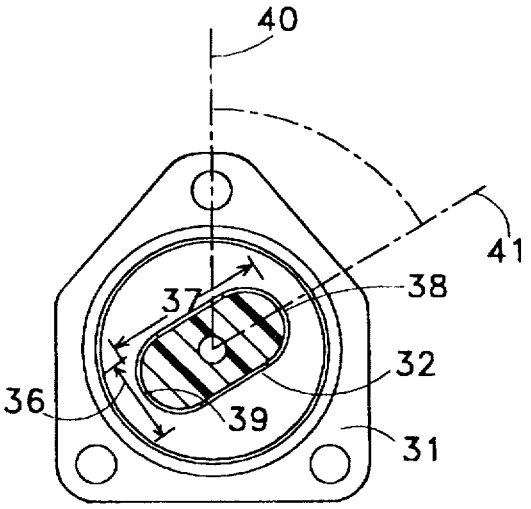
FIG. 7 is a cross-sectional view taken along line 7—7 of FIG. 6.

The stud assembly 30 is shown in side view in FIG. 6 where the stud member can be seen to have a stud extension width 34 and a button thickness 35. FIG. 7 is a cross-sectional view taken along line 7—7 of FIG. 6 where the stud member 32 can be seen to have a stud width 36 and a stud length 37. The throat has a width 29 with a narrowmost portion 29'. The narrowmost portion 29' of throat 18 should be only slightly greater than the stud width 36. It is also preferable that throat 18 be wider at its opening than at the open area 20. The stud member has a rounded end 38 at one end and a second rounded end 39 at the other end. Also in FIG. 7 the vertical central axis of the stud assembly is shown and indicated by reference character 40. The stud assembly is mounted on a tool or on a holster and is mounted in such a way that it is away from the center of gravity of the tool and thus, it hangs in a direction so that the vertical central axis of the stud assembly 40 is positioned vertically. The stud member 32 has a central axis indicated by reference character 41 in FIG. 7 and this is at an angle "b" from the vertical central axis 40. Angle "b" should be about 60° plus or minus 5° to provide an appropriate orientation when the tool is being inserted or removed by a user from the user's belt.

The action of dropping a tool into the slotted member is shown in FIGS. 10, 11, 12 and 13. There a tool indicated by reference characters 42 is shown and the stud assembly 30 is mounted thereto so that its vertical central axis 40 is aligned with the vertical central axis of tool 42. The center of gravity of the tool is indicated by reference character 43. Stud assembly 32 is shown in a cross-sectional view analogous to FIG. 7 where the stud member 32 is shown in cross-sectional view. The slotted member 10 is shown in a rear view from a position just inside of the back plate 22 which is not shown. The angled wide mouth opening 15 is shown from the rear where the stud sliding edge is shown as is the stud sliding edge 17. The stud holding area 20 the stud receiving throat 18 and the stud stopping edge 16 are also shown.

Figure 11:
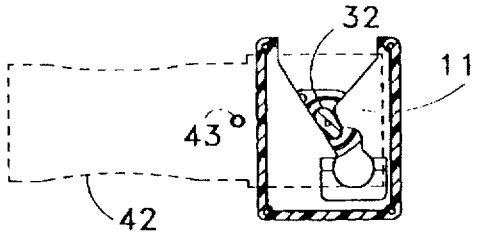
FIG. 11 is a rear view analogous to FIG. 9, except that the tool has entered the throat area of the slotted member of FIG. 1.
Figure 12:
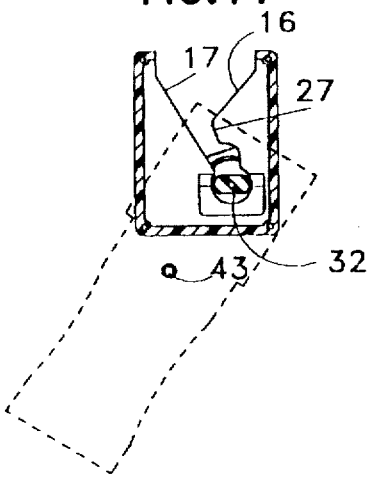
FIG. 12 is a rear view analogous to FIGS. 9 and 10, but showing the tool with an oblong stud attached thereto in the stud holding area.
Figure 13:
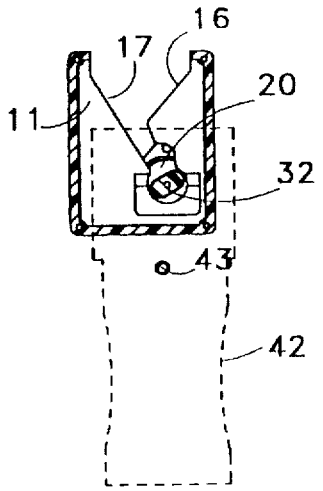
FIG. 13 is a rear view analogous to FIGS. 9 through 11 showing the tool in a freely hanging orientation.

Thus, the user would rotate tool 42 to a generally horizontal position to insert it into the slotted member 10 and in this position the stud member 32 can slide along the stud sliding edge 17 easily through the throat 18 into the stud holding area 20. However, if the tool is moved from the 90° position while the stud member 32 is in the stud receiving throat 18, this action is very easily noted by the wearer. The length of the throat should be about ⅜" long. Unlike applicant's earlier version shown in FIG. 8, it is necessary to move the stud member downwardly for a distance at least equal to the length 19 of the throat before it is once again free to return to a vertical position and stud holding 20. Thus, as shown in FIG. 11, the tool is restrained in a 90° configuration and if the user were to simply drop the tool at this time, it would be held up in this horizontal position where it would be very noticeable to the user. Thus, the tool must drop to a position shown in FIG. 12 before it will drop and be suspended truly in a vertical position as shown in FIG. 13. Also, as shown in FIGS. 12 and 13, it is evident that the tool is permitted to rotate freely in the stud holding area 20 so that the user will be comfortable and when the user bends over, the tool can remain vertical. Also, the tool does not reach a position at which it can be removed unless the tool is oriented horizontally when the tool can be removed.

Figure 8:
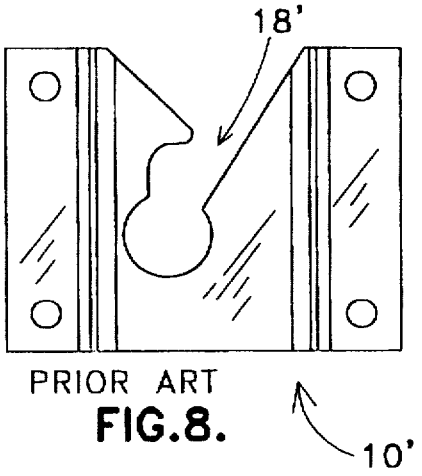
FIG. 8 is a front view of a prior art slotted member.
Figure 9:
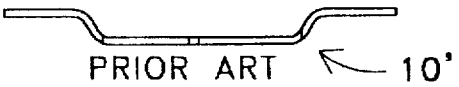
FIG. 9 is a top view of the prior art of the slotted member of FIG. 8.
Figure 10:
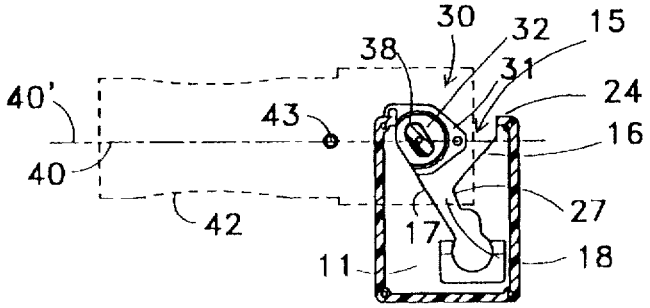
FIG. 10 is a rear view partly in cross-section looking outwardly from the slotted member of FIG. 1 and showing the stud assembly in cross-sectional view analogous to FIG. 7 showing a tool in phantom view rotated 90° from the horizontal.

The improvement over the configuration of applicant's earlier version of FIG. 8 is significant. The false locking position which occurs when the stud member 32 rests against the stud sliding edge and the stud stopping edge above doorway 18' is practically eliminated. The user very easily notices the dropping through the stud receiving throat and thus, is not fooled by a false locking position.

Figure 3:
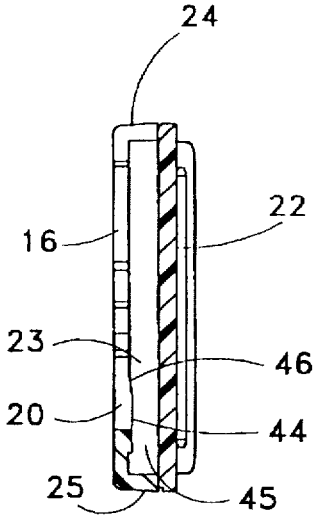
FIG. 3 is a cross-sectional view thereof.
Figure 14:
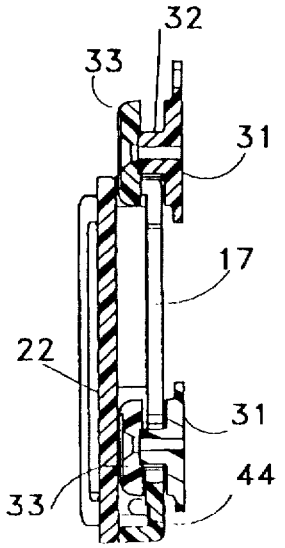
FIG. 14 is an enlarged cross-sectional view showing a stud assembly moving downwardly into the slotted member shown in cross-sectional view.

As shown in FIG. 14, a button contact wedge plate 44 contacts the underside of button or flange 33 and prevents the stud assembly 30 from tilting in and out in a significant amount. As shown best in FIGS. 3 and 4 of the drawings, it is preferred that this button contact wedge plate 44 have a wedge-shaped portion beginning at the upper edge 46 so that the button 33 is smoothly moved into the correct oriented position in the stud holding area 20. Once the button 33 is in the stud holding area, there should be no more than about 1/32" between the button 33 and the wedge plate 44.

While the device is shown in the drawings with the stud assembly 30 affixed to the tool, it is, of course, possible that the slotted member 10 may be affixed to the tool and the stud assembly 30 affixed to the wearer's belt or other holding surface. In this configuration, of course, the angled wide mouth opening 15 would be oriented downwardly and the slotted member 10 would be turned with the tool to allow it to capture the stud assembly 30 which would be on the wearer's belt or other holding surface. Also, while the device is discussed as being held on the wearer's belt, it is, of course, appropriate that it be held on a vehicle or other moveable or stationary member. The tool hanging device of the present invention permits a great deal of movement for the wearer and greatly facilitates the use of battery operated devices.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A tool hanging device having a first member affixable to a tool and a second member affixable to a hanging surface, said tool hanging device comprising:

one of said first and second members comprising a slotted member, said slotted member (10) having a front plate (11) and a back plate (22), said front plate (11) having an outer face (12) and an inner face (13), a top (24) and a bottom (25) and a thickness (14), said front plate (11) having an open area (21) between the inner face (13) and the back plate (22), said open area (21) having an open area width (23), said front plate (11) having an angled, wide-mouthed opening (15) beginning at the top (24) and said wide-mouthed opening (15) having a stud sliding edge (17) and a stud-stopping edge (16), said stud-stopping edge (16) terminating at a stud-receiving throat (18) between a throat edge (27) and the stud sliding edge (17), said throat (18) having a throat width (29) with a narrowmost portion (29') and a throat length (19) and said throat edge (27) continuing generally parallel to said stud-sliding edge (17) and said stud-sliding edge (17) terminating in a stud holding area (20), said stud holding area (20) continuing until it intersects said throat edge (27) and said slotted member (10) having a slotted member vertical central axis (28) and said stud sliding edge (17) at said throat (18) having an angle of between about 25 and 35 degrees from said slotted member central axis (28);

the other of said first and second members comprising a stud assembly (30) having a supporting plate (31), a stud member (32) extending outwardly a stud extension distance (34) from said supporting plate (31), said stud member (32) having two rounded ends (38, 39) spaced apart from each other a stud length (37), said stud member (32) having a stud width (36) and said stud width (36) being narrower than said stud length (37) and narrower than said narrowmost portion (29') of said throat width (29) and said stud length (37) being greater than said narrowmost portion (29') of said throat width (29), said stud member (32) terminating in an overhanging button (33), said overhanging button (33) having a button thickness (35) less than the width (23) of said open area behind said front plate, the stud extension distance (34) being greater than the thickness (14) of said front plate and the stud assembly having a stud assembly vertical central axis (40) and a line extending through a stud central axis (41) of said stud is at an angle between about 55 and 65 degrees with respect to said stud assembly vertical central axis (40); and wherein said throat length (19) is at least the length of one half the stud length (37) whereby when the tool (42) is held by one of said first and second members (10 or 30) above a tool center of gravity (43), said one of said first and second members (10 or 30) is oriented so that it hangs freely with its vertical central axis (28 or 40) oriented vertically and the second of said first and second members (30 or 10) is affixed to a supporting member so that its vertical central axis (40 or 28) is oriented vertically and when said tool (42) is dropped into said second of said first and second members (10 or 30), said wide-mouthed opening (15) contacts said stud member (32) and said button (33) enters the open area (21) behind said front plate (11), said stud member (32) abuts said stud sliding edge (17) and said stud stopping edge (16) where it is retained against the stud stopping edge (16) and the stud sliding edge (17) adjacent the throat (18) until said tool (42) is rotated about 90 degrees when said stud member (32) becomes aligned with said throat (18) and the stud member (32) moves into the stud holding area (20) where the tool (42) is free to return so that a vertical central axis of the tool (40') is oriented vertically.

2. The tool hanging device of claim 1 wherein said first member is the stud assembly (30) and said second member is the slotted member (10).

3. The tool hanging device of claim 1 further including a button contact wedge plate (44) located in said open area (21) to narrow said open area (21) to a narrowed open area (45) at a position so that the button contact wedge plate (44) contacts said button (33) when said button (33) is in said stud holding area (20).

4. The tool hanging device of claim 3 wherein said button contact wedge plate (44) is located on said inner face (13) of said front plate (11).

5. The tool hanging device of claim 4 wherein said button contact wedge has an uppermost edge (45) which intersects said stud holding area.

6. The tool hanging device of claim 1 wherein said throat length (19) is about 3/8".

7. The tool hanging device of claim 1 wherein said throat (18) has a straight throat edge (27) which is positioned at an angle of about ten degrees with respect to said stud sliding edge (17).

8. The tool hanging device of claim 1 wherein said first and second members are fabricated from a polymer.

9. The tool hanging device of claim 1 wherein said throat width (29) be wider at its intersection with said stud stopping edge (16) than at an intersection with said stud holding area (20).

10. A tool hanging device having a stud assembly affixable to a tool and a slotted member affixable to a hanging surface such as a belt, said tool hanging device comprising:

a slotted member (10) having a front plate (11) and a back plate (22), said front plate (11) having an outer face (12) and an inner face (13), a top (24) and a bottom (25) and a thickness (14), said front plate (11) having an open area (21) between said back plate (22) and the inner face (13), said open area (21) having an open area width (23), said front plate (11) having an angled, wide-mouthed opening (15) at the top (24) and said wide-mouthed opening (15) having a stud sliding edge (17) and a stud-stopping edge (16), said stud-stopping edge (16) terminating at a stud-receiving throat (18) having a throat edge (27) and a throat width (29) with a narrowmost portion (29') and a throat length (19) and said throat edge (27) continuing at a slight angle to said stud-sliding edge (17) oriented so that the narrowmost portion is adjacent a stud holding area (20) and said stud-sliding edge (17) terminating in said stud holding area (20), said stud holding area (20) continues until it intersects said throat edge (27) and said slotted member (10) having a slotted member vertical central axis (28) and said stud sliding edge (17) having an angle of between about 25 and 35 degrees from said slotted member central axis (28) and said slotted member further including a button contact wedge plate (44) located in said open area (21) extending inwardly from the inner face (13) to form a narrowed open area (45) at a position so that the button contact wedge plate (44) contacts said button (33) when said button (33) is in said stud holding area (20);

a stud assembly (30) having a supporting plate (31), a stud member (32) extending outwardly a stud extension distance (34) from said supporting plate (31), said stud member (32) having two rounded ends (38, 39) spaced apart from each other a stud length (37), said stud member (32) having a stud width (36) and said stud width (36) being narrower than said stud length (37) and narrower than said narrowmost portion (29') of said throat width (29) and said stud length (37) being greater than the width of said narrowmost portion (29') of said throat width (29), said stud member (32) terminating in an overhanging button (33), said overhanging button (33) having a button thickness (35) less than the width (23) of said open area behind said front plate (11), the stud extension distance (34) being greater than the thickness (14) of said front plate and the stud assembly having a stud assembly vertical central axis (40) and a line extending through a stud central axis (41) of said stud is at an angle between about 55 and 65 degrees with respect to said stud assembly vertical central axis (40); and wherein said throat length (19) is at least the length of one half the stud length (37) whereby when a tool (42) is held by said stud assembly (30) above the tool center of gravity (43), the stud assembly (30) is oriented so that it hangs freely with its vertical central axis (40) oriented vertically and the slotted member (10) is affixed to a supporting member so that its vertical central axis (28) is oriented vertically and when the stud assembly (30) affixed to said tool (42) is dropped into said angled wide mouth opening (15) of said slotted member (10), said stud member (32) contacts said wide-mouthed opening (15) and said button (33) enters the open area (21) behind said front plate (11), said stud member (32) abuts said stud sliding edge (17) and said stud stopping edge (16) where it is retained against the stud stopping edge (16) and the stud sliding edge (17) adjacent the throat (18) until said tool (42) is rotated about 90 degrees when said stud member (32) becomes aligned with said throat (18) and the stud member (32) moves into the stud holding area (20) where the tool (42) is free to return so that the vertical central axis of the tool (40') is oriented vertically.

11. The tool hanging device of claim 10 wherein said button contact wedge plate (44) extends from a middle area of said stud holding area (20) to a point below said stud holding area (20).

12. The tool hanging device of claim 11 wherein the thickness of said button contact wedge plate (44) and the thickness (14) of said front plate (11) is less than said stud extension width (34) by about 1/32".

* * * * *